US008668028B2

(12) United States Patent
Finkenzeller

(10) Patent No.: US 8,668,028 B2
(45) Date of Patent: Mar. 11, 2014

(54) UNDERWATER DRILLING ARRANGEMENT AND METHOD FOR INTRODUCING A TUBULAR FOUNDATION ELEMENT INTO THE BED OF A BODY OF WATER

(75) Inventor: Stefan Michael Finkenzeller, Reichertshofen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 537 days.

(21) Appl. No.: 12/942,712

(22) Filed: Nov. 9, 2010

(65) Prior Publication Data

US 2011/0272194 A1 Nov. 10, 2011

(30) Foreign Application Priority Data

Nov. 17, 2009 (EP) ..... 09014374

(51) Int. Cl.
*E21B 7/128* (2006.01)

(52) U.S. Cl.
USPC ..... 175/7; 175/207; 166/358; 405/232

(58) Field of Classification Search
USPC ..... 175/5–7, 10, 207, 209; 166/358, 71–73, 166/78.1; 405/228, 232, 244, 248, 249
See application file for complete search history.

(56) References Cited

U.S. PATENT DOCUMENTS 3,519,071 A * 7/1970 Word, Jr. ..... 166/351
3,608,652 A * 9/1971 Medders et al. ..... 175/7
3,621,910 A * 11/1971 Sanford et al. ..... 166/335
3,656,549 A * 4/1972 Holbert et al. ..... 166/356
3,831,386 A * 8/1974 Phares et al. ..... 405/249
4,043,407 A * 8/1977 Wilkins ..... 175/50
4,131,166 A * 12/1978 Schnell ..... 173/193
4,255,068 A * 3/1981 Valantin ..... 405/195.1
4,352,595 A * 10/1982 Scodino ..... 405/158

(Continued)

FOREIGN PATENT DOCUMENTS

| | | | |
|---|---|---|---|
| EP | 0520544 | A1 | 12/1992 |
| GB | 2448358 | A | 10/2008 |
| JP | 58-091222 | | 5/1983 |
| KR | 10-0773227 | B1 | 10/2007 |

OTHER PUBLICATIONS

H. Geiger; "European Search Report"; EP 09014374; Feb. 2, 2010.

*Primary Examiner* — Matthew Buck
(74) *Attorney, Agent, or Firm* — Studebaker & Brackett PC

(57) ABSTRACT

The invention relates to an underwater drilling arrangement for introducing a tubular foundation element into the bed of a body of water comprising at least one rotary drill drive, whereby a drill rod running inside the foundation element can be set into rotation by means of the rotary drill drive. The invention is characterized, among other things, in that a submersible working platform for placement onto the bed of a body of water is provided, whereby on the working platform at least one holding means for securing the foundation element in a rotationally fixed manner on the working platform is arranged and in that at least one mounting part for placement onto the foundation element is provided, whereby the mounting part has a clamping means for securing the mounting part on the foundation element, and the rotary drill drive is arranged on the mounting part. The invention also relates to a method for introducing a tubular foundation element into the bed of a body of water, which can be carried out, in particular, by means of the underwater drilling arrangement according to the invention.

14 Claims, 6 Drawing Sheets

(56) References Cited

U.S. PATENT DOCUMENTS

| | | | | | |
|---|---|---|---|---|---|
| 4,432,671 | A * | 2/1984 | Westra et al. | 405/226 |
| 4,558,744 | A * | 12/1985 | Gibb | 166/335 |
| 4,575,282 | A * | 3/1986 | Pardue et al. | 405/228 |
| 4,744,698 | A * | 5/1988 | Dallimer et al. | 405/226 |
| 4,904,119 | A * | 2/1990 | Legendre et al. | 405/228 |
| 5,244,312 | A * | 9/1993 | Wybro et al. | 405/204 |
| 5,794,716 | A * | 8/1998 | White | 173/189 |
| 5,951,207 | A * | 9/1999 | Chen | 405/232 |
| 6,659,182 | B1 * | 12/2003 | Saugier et al. | 166/358 |
| 7,380,614 | B1 * | 6/2008 | Williamson et al. | 175/6 |
| 7,703,534 | B2 * | 4/2010 | Sheshtawy | 166/358 |
| 2005/0109537 | A1 * | 5/2005 | Ayling | 175/5 |
| 2010/0119309 | A1 * | 5/2010 | Gibberd | 405/228 |
| 2011/0158752 | A1 * | 6/2011 | Hitchin | 405/232 |
| 2012/0177447 | A1 * | 7/2012 | Fraenkel et al. | 405/232 |

* cited by examiner

UNDERWATER DRILLING ARRANGEMENT AND METHOD FOR INTRODUCING A TUBULAR FOUNDATION ELEMENT INTO THE BED OF A BODY OF WATER

The invention relates to an underwater drilling arrangement for introducing a tubular foundation element into the bed of a body of water in accordance with the preamble of claim 1. Such a drilling arrangement has at least one rotary drill drive, whereby a drill rod running inside the foundation element can be set into rotation by means of the rotary drill drive. The invention further relates to a method for introducing a tubular foundation element into the bed of a body of water in accordance with claim 12.

There is an ever increasing necessity for foundations implemented within the bed of a body of water, particularly in the offshore area, for example for anchoring wind power plants, oil- and gas-delivery means etc.

A generic drilling arrangement is known from GB 2 448 358 A. According to the teaching of GB 2 448 358 A a load-bearing frame structure for an offshore electricity generation plant is anchored to the bed of the sea. For this purpose an underwater drilling arrangement with several drilling units is provided, which, for the purpose of fastening the frame structure, are attached temporarily on the frame structure to be fastened. The drilling units can each have a rotary drill drive which is arranged in a linearly displaceable manner in a guide sleeve. By means of the rotary drill drive a drill rod is introduced into the ground, on which a tubular foundation element is in turn fastened. Following drilling the foundation element is released from the drill rod and remains in the bed of the body of water where it can secure the frame structure, while the drill rod is recovered together with the drilling units.

A similar arrangement is described in GB 2 431 189 A. According to GB 2 431 189 A provision is made for the drill drive to be guided directly on the frame structure to be fastened.

The object of the invention is to provide an underwater drilling arrangement and a method for introducing a tubular foundation element into the bed of a body of water, which, whilst featuring especially high reliability and cost efficiency, can be employed in a great variety of applications.

The object is solved in accordance with the invention by an underwater drilling arrangement having the features of claim 1 and by a method having the features of claim 12. Preferred embodiments are stated in the respective dependent claims.

The underwater drilling arrangement according to the invention is characterized in that a submersible working platform for placement onto the bed of a body of water is provided, whereby on the working platform at least one holding means for securing the foundation element in a rotationally fixed manner on the working platform is arranged, and in that at least one mounting part for placement onto the foundation element is provided, whereby the mounting part has a clamping means for securing the mounting part on the foundation element, and the rotary drill drive is arranged on the mounting part.

A first idea of the invention resides in the fact that the drilling arrangement has a submersible working platform, on which the foundation element is secured at least temporarily during drilling. Hence, according to the invention the foundation element is primarily guided during drilling by an independent working platform that is specifically provided for foundation purposes and not, as known from prior art, by the load-bearing structure that is to be anchored to the ground. As a result, the masses that have to be placed in a single work process onto the bed of a body of water are comparatively small, because according to the invention the foundation process can take place separately from the installation of the load-bearing frame structures. This proves to be of advantage regarding the necessary cost expenditure. Furthermore, an especially wide range of applications is provided in accordance with the invention.

A further fundamental idea of the invention can be seen in the fact that the reaction forces occurring during rotary drilling are transmitted via the foundation element to the working platform. Thus, in accordance with the invention the foundation element assumes a double function, according to which it firstly serves as a load-bearing structure on completion of the drilling process and secondly, during the drilling process, it serves to transmit the forces that occur during drilling so that the foundation element can also be considered as a part of the drilling unit. In this way, in accordance with the invention, as the foundation element, present anyway, also takes over tasks of the drilling unit it is possible for the drilling unit to be designed in an especially light-weight and cost-efficient manner in accordance with the invention.

In order for the foundation element to be able to transmit the reaction forces occurring during rotation of the drill rod to the working platform, provision is made on the one hand in accordance with the invention for the rotary drill drive to be secured in a rotationally fixed manner, in particular clamped, via the clamping means on the foundation element so that the reaction forces of the rotary drill drive and therefore of the drill rod are passed on via the clamping means to the foundation element. The foundation element, in turn, is secured by the holding means in a rotationally fixed manner at least temporarily on the working platform, thus making it possible for the reaction forces to be passed from the foundation element to the working platform.

An idea of the invention can therefore also reside in the fact that during drilling the foundation element does no co-rotate with the drill rod, which is of advantage with regard to wall friction and therefore energy consumption. For example provision can be made for the tubular foundation element, which can also be referred to as drill pipe, to be sunk as a result of its proper weight into the drill-hole excavated by the drill rod.

In accordance with the invention the rotary drill drive can be designed purely for rotary operation. However, it can also be designed in a roto-percussive manner. In particular, provision can be made for the rotary drill drive to have a drill rod connection, and by means of the rotary drill drive the drill rod connection can be rotated relative to the clamping means of the mounting part. For best suitability, the rotary drill drive is of hydraulic design. In addition to a motor the rotary drill drive can also have at least one gear unit. Along the course of the drill rod a separate percussion unit can be provided, too. It is useful for the drill rod to have a drill head at its underside.

The working platform can be designed as a work deck in particular. The invention permits the use of working platforms, whose height is smaller than the length of the drill rod and/or the tubular foundation element. Due to the fact that according to the invention the foundation element itself serves for the transmission of force, a mast or drilling derrick can be dispensed with. The working platform can be lowered from a floating body, as for example from a ship or floating platform, onto the bed of a body of water. For lowering and recovering the working platform a cable arrangement can be provided in particular.

Advantageously, the clamping means is designed such that it permits a coaxial securing of the mounting part and/or the rotary drill drive on the tubular foundation element. In particular, provision can be made for the mounting part to be placed onto the foundation element and secured with the clamping means such that its drill rod connection runs coaxially to the foundation element. For best suitability, the holding means is designed for releasably securing the foundation element in a rotationally fixed manner.

A preferred idea of the invention can reside in the fact that the working platform and the mounting part form a part of the underwater drilling arrangement. The drill rod and the foundation element can be considered as parts of the underwater drilling arrangement or also as separate parts.

In accordance with the invention it is preferred that in particular on the mounting part at least one feeding means for axial displacement of the drill rod is arranged. A feeding means according to the invention renders it possible for additional contact pressure to be exerted onto the drill rod so that an especially great drilling progress can be achieved. In particular, provision can be made in that by way of the feeding means the drill rod connection is axially displaceable relative to the mounting part, more particularly to the clamping means of the mounting part. The axial direction can preferably be understood as the drilling direction, i.e. the longitudinal direction of the drill rod and/or the foundation element. By preference, the feeding means is provided on the mounting part. It can be integrated into the rotary drill drive in particular. Hence, the feeding means is preferably arranged on the pipe collar of the foundation element. Basically, the feeding means can also be provided e.g. on the working platform, in which case the feeding means can then take effect between the working platform and the foundation element so that by means of the feeding means the foundation element can be displaced axially together with the drill rod relative to the working platform.

Another preferred embodiment of the invention resides in the fact that means for axially securing the foundation element in a releasable manner on the working platform are provided. Through these means for axial securing, the foundation element can be secured axially relative to the working platform during lowering and/or at least temporarily during drilling of the drill rod. The means can have jaws, for example, that come to rest against the foundation element and thereby secure the foundation element in a force- or/and form-locking manner.

In particular, the means for axially securing the foundation element can be provided on the holding means for securing the foundation element in a rotationally fixed manner. In this embodiment the holding means assumes a double function as it is able to secure the foundation element not only in a rotationally fixed manner but also axially. As a result, a device of especially simple construction is achieved. For example provision can be made for the means for axial securing and/or the holding means to be released repeatedly during drilling in order to enable the drill rod and/or the foundation element to slide down after a partial drilling process.

Furthermore, it is preferred that the clamping means for securing the mounting part on the foundation element has at least one hydraulic clamp. For instance three or four clamps can be provided that are distributed equidistantly on the pipe collar of the foundation element. The hydraulic clamp can have a hydraulic clamping cylinder in particular that runs radially to the foundation element and preferably juts out at the outside of the foundation element.

Another advantageous embodiment of the invention resides in the fact that on the working platform at least one linear guide for the foundation element is arranged. In this way bending moments occurring in the foundation element can be reduced and jamming of the foundation element can be prevented in particular. Advantageously, provision can be made for the working platform to have a passage opening for the foundation element, whereby the linear guide is preferably arranged above the passage opening. More particularly, the linear guide can be arranged above the holding means. For example the linear guide can be designed as a slide bush.

If a linear guide is provided, it is especially useful that it can be released from the foundation element. This embodiment allows for especially great drilling depths because in the case of greater drilling depths, when additional guidance of the foundation element is no longer required, the linear guide can be removed from the foundation element so that the mounting part that usually has a greater diameter can then be lowered, too.

For instance provision can be made in accordance with the invention for the linear guide to have at least two jaw elements. These jaw elements can be designed in an at least approximately semi-cylindrical manner for example so that they can jointly form a slide bush for the foundation element. The two jaw elements can be actuated hydraulically e.g. for releasing and closing the linear guide. In particular, they can be arranged on a tong arrangement that can suitably be actuated in a hydraulic manner.

Another preferred embodiment of the invention resides in the fact that the linear guide can be moved in particular transversely to its guiding direction on the working platform. The linear guide can thus be moved transversely to the axial direction of the foundation element, i.e. transversely to the drilling direction. As a result, the linear guide can be temporarily moved away from the foundation element so that e.g. a mounting part for the foundation element that has a larger diameter in comparison with the foundation element is not obstructed by the linear guide and drilling into especially great depths is rendered possible.

Moreover, it is advantageous for the working platform to have supports, especially hydraulic supports for aligning the working platform on the bed of a body of water. For best suitability, the supports are arranged laterally on the working platform so as to permit especially good stability. The supports suitably have a base part each, which can be displaced by a linear drive at least in the vertical direction, i.e. in the axial direction, whereby the linear drive preferably has at least one hydraulic cylinder. By means of the supports according to the invention the working platform can be arranged on the bed of a body of water in a horizontal or also in a selective angular fashion depending on the drilling project.

The working platform can constitute a drilling template that predetermines a specific drilling pattern. In this context it can be especially advantageous that for the purpose of adjustment of the drilling point at least the holding means for the foundation element can be moved relative to the working platform, namely by preference in a direction lying transversely to the axial direction of the foundation element, i.e. at least approximately horizontally. In this way it is possible to selectively move with the foundation element and the drill rod arranged therein to the intended drilling points and thereby produce the intended pattern of the drilling template.

Especially with regard to the function as drilling template it is furthermore advantageous for several drilling units to be provided on the working platform. For example four drilling units can be provided. Within the meaning of the invention a drilling unit can, in particular, each have at least one holding means according to the invention for securing a foundation element in a rotationally fixed manner on the working platform. In addition, the drilling units within the meaning of the invention can each have a mounting part according to the invention with clamping means and rotary drill drive and/or a linear guide according to the invention for the foundation element. Consequently, a drilling unit within the meaning of the invention advantageously has a holding means, a mounting part and/or a linear guide.

If several drilling units are provided, they can be supplied with energy via a common umbilical or via separate umbilicals for each drilling unit.

Moreover, it is especially useful for the drill rod to have a flush drilling means. The flush drilling means can have e.g. at least one flush hose for supplying flush fluid, in particular gas, to the drill rod and/or a flush head, i.e. a rotary feed-through for coupling the hose to the rotating drill rod. By way of such a flush means a flush process can be effected in the drill rod for removing drill spoil from the drill-hole.

In addition, it is of advantage that the drill rod has a gooseneck for drill spoil removal. A gooseneck can be understood, in particular, as a removal pipe which is bent at least in some areas, which preferably runs radially to the drilling direction in its upper part and from which the removed drill spoil emerges at a distance from the mouth of the drill-hole.

In addition, it is preferred that the drill rod has at least one drill collar in order to increase the imposed load. For the sake of better assembly the drill rod can consist of several rod sections, in which case at least a part of the rod sections can be designed as drill collars.

An especially good drilling effect is rendered possible according to the invention in that the drill rod has a full-cut drill head with roller bits in particular. The drill head can have an adjustable cross-section so that the drill head can operate below the foundation element on the one hand and can also be pulled through the foundation element on the other hand. The drill head is arranged on the ground-facing side of the drill rod.

Operational reliability can be enhanced in that on the working platform a winding device for at least one flush line is provided. The winding device can have e.g. a reel for winding up the flush lines and advantageously also at least one deflection roller so as to ensure especially reliable winding.

The invention also relates to a method for introducing a tubular foundation element into the bed of a body of water, in which a submersible working platform is provided, the foundation element is secured by means of a holding means in a preferably rotationally and/or axially fixed manner on the working platform, a mounting part is placed onto the foundation element and secured on the said foundation element by means of a clamping means, the working platform is submerged and placed onto the bed of a body of water, and by means of a rotary drill drive arranged on the mounting part a drill rod running inside the foundation element is set into rotation and introduced into the bed of a body of water whilst producing a drill-hole, whereby the foundation element is sunk into the drill-hole as a result of its proper weight. The method can be carried out, in particular, with the underwater drilling arrangement according to the invention, whereby the advantages set out in this connection can be realized.

It is especially advantageous, in particular with regard to the expenditure of time, that on completion of the drill-hole the working platform is recovered together with the drill rod. To recover the drill rod provision can be made, for example, for the drill rod to be secured on the working platform by way of the holding means for the foundation element. However, a separate holding means for the drill rod can be provided, too. Before recovery of the drill rod this is advantageously uncoupled from the sunken foundation element. To this end the clamping means is suitably released.

Furthermore, it is useful that prior to the placement of the working platform onto the bed of a body of water the foundation element is arranged on the working platform and preferably secured axially on the said working platform. In particular, according to this embodiment the foundation element can be placed onto the working platform as early as before submersion of the working platform, for best suitability above the water surface. As a result, the amount of work can be reduced considerably, since the working platform can be loaded with the foundation element whilst still being accessible from a ship or a floating platform. For axial securing of the foundation element during submersion use can be made of the holding means for example.

In addition, it is of advantage that the mounting part is placed onto the foundation element prior to the placement of the working platform onto the bed of a body of water. This equally leads to a reduction of the amount of work, as the mounting part can be installed whilst still being accessible from the ship or floating platform. During submersion the mounting part can then be secured on the foundation element by making use of the clamping means.

In the following the invention will be explained in greater detail by way of preferred embodiments illustrated schematically in the accompanying Figures, wherein.

Figure 1:
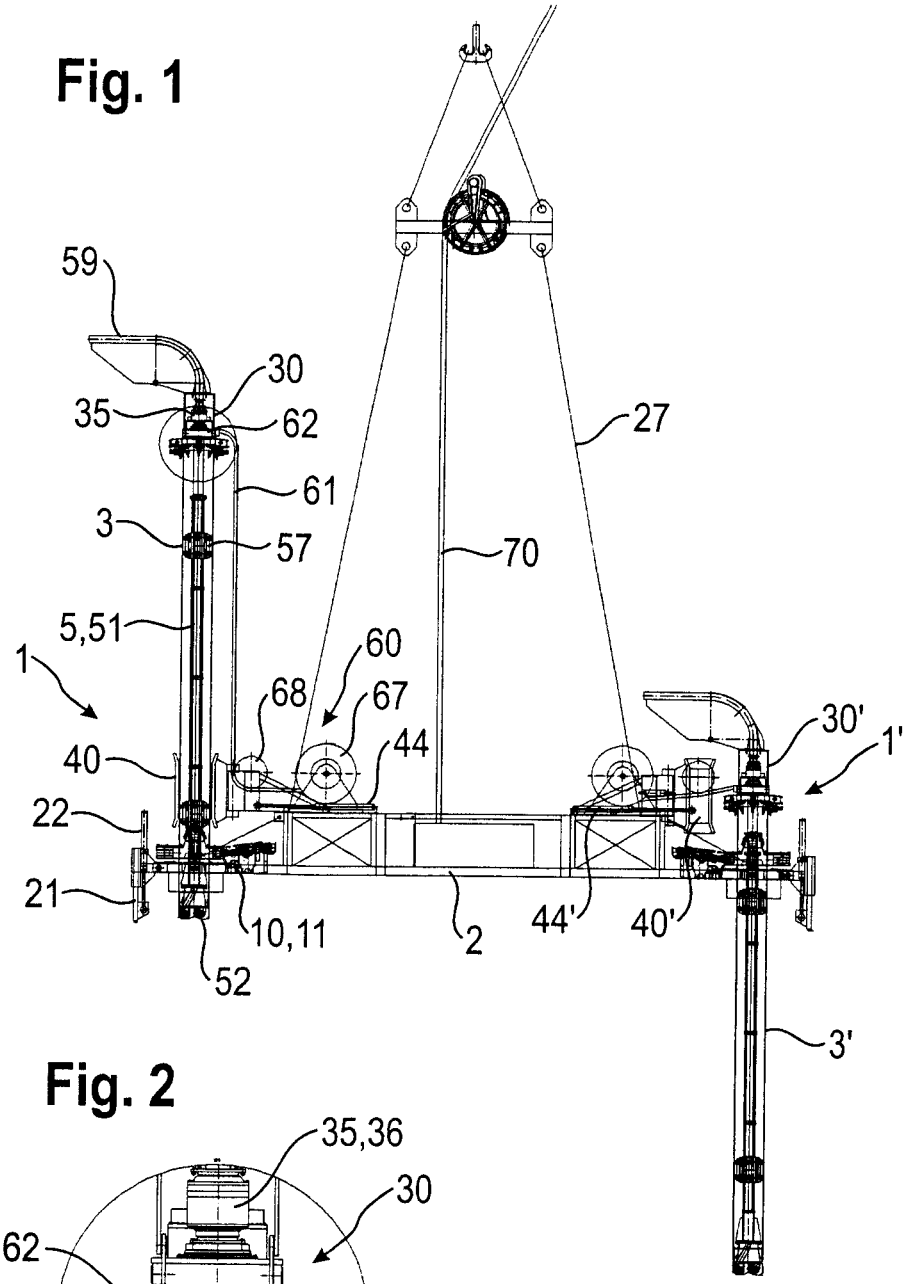
FIG. 1 shows a side view of an underwater drilling arrangement for carrying out the method according to the invention.
Figure 4:
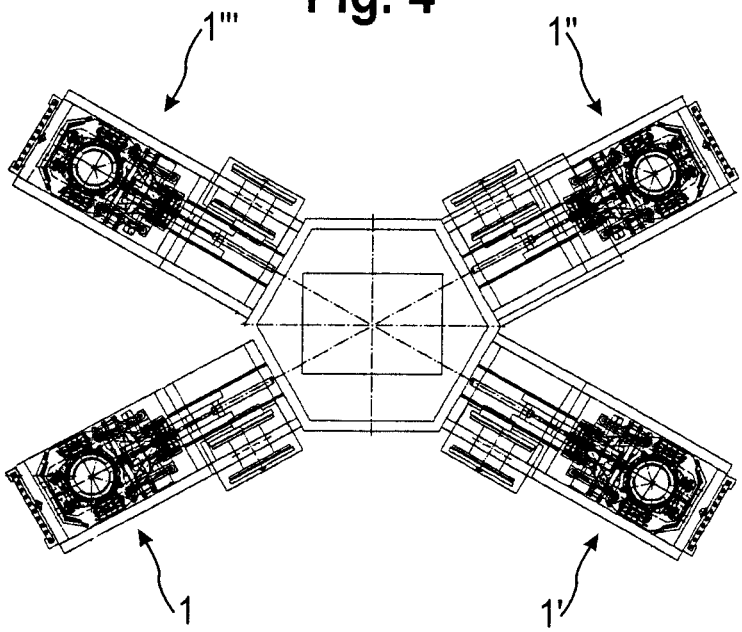
FIG. 4 shows a view of the device of FIG. 1 from above.

An embodiment of an underwater drilling arrangement according to the invention is shown in FIGS. 1 and 4 and its use in a method according to the invention is shown in FIGS. 5 to 8.

As shown in FIG. 1, the underwater drilling arrangement according to the invention has a working platform 2 which is suspended on a cable arrangement 27 and can be lowered via this cable arrangement 27 onto the bed of a body of water.

As shown in FIG. 4, on the working platform 2 a total of four drilling units 1, 1', 1", 1''' are arranged, of which only the drilling units 1 and 1' can be seen in the side view of FIG. 1. The four drilling units 1, 1', 1" and 1''' are arranged at the corners of a geometrical rectangle.

The four drilling units 1, 1', 1" and 1''' are substantially designed in analogy so that in the following only the first drilling unit 1 will mainly be described in detail. The remaining drilling units 1', 1" and 1''' substantially have the same elements as drilling unit 1, with elements of similar type in the case of the drilling units 1', 1" and 1''' being designated with stroke-marked reference signs.

The first drilling unit 1 serves to introduce a tubular foundation element 3 into the bed of a body of water. The drilling unit 1 has a sleeve-like linear guide 40, which guides the foundation element 3 in a vertically displaceable manner on the working platform 2 and which is described in detail below. The drilling unit 1 furthermore has a holding means 10 for securing the foundation element 3 in a rotationally fixed manner on the working platform 2. This holding means 10 is arranged below the linear guide 40 on the working platform 2. The holding means 10 can be designed as hydraulic clamping means for example and also contains means 11 for axially securing the foundation element 3, i.e. means for securing against a displacement in the vertical direction. The holding means 10 can thus ensure that during lowering of the working platform 2 but also during the drilling process the foundation element 3 keeps its rotational position and also its axial position relative to the working platform 2.

For the production of a drill-hole, into which the foundation element 3 is introduced, a drill rod 5 is provided. The drill rod 5 runs inside the foundation element 3. At the lower end of the drill rod 5 a drill head 52 designed as a full-cut drill head is arranged that is equipped with roller bits. The drill head 52 juts out at the lower end of the foundation element 3 beyond the said foundation element 3 so that the drill head 52 can remove soil material below the foundation element 3. The drill rod 5 consists of several rod sections, in which case drill collars 51 can also be provided in order to increase the imposed load. Via at least one support 57 that juts out radially from the drill rod 5, the said drill rod 5 supports itself on the inner wall of the foundation element 3. To reduce friction in the case of rotation of the drill rod 5 relative to the foundation element 3 rollers can be provided circumferentially on the support 57. In the example of FIG. 1 two supports are provided.

For rotational actuation of the drill rod 5 the drilling unit 1 has a mounting part 1 on which a rotary drill drive 35 is arranged. The rotary drill drive 35 has an output shaft with a drill rod connection on which the drill rod 5 is arranged. For drilling, the mounting part 30 is placed together with the drill rod 5 onto the upper pipe collar of the tubular foundation element 3.

Figure 2:
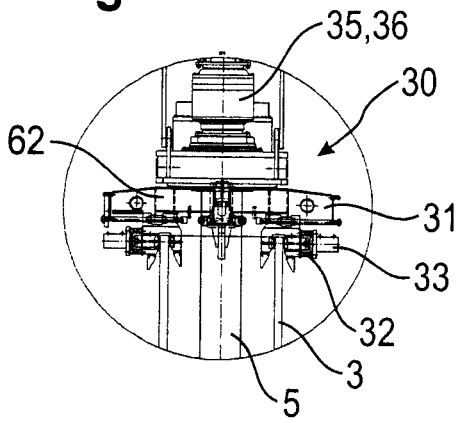
FIG. 2 shows an enlarged detailed view of the arrangement of FIG. 1 in the area of the mounting part 30.

As shown in FIG. 2 in particular, the mounting part 30 has a clamping means 31 with several hydraulic clamps 32, with which the mounting part 30 can be secured on the foundation element 3. The clamps 32 each have a hydraulic cylinder 33 that extends radially outwards from the foundation element 3.

By means of the rotary drill drive 35 the drill rod 5 can be rotated relative to the clamping means 31 and therefore also relative to the foundation element 3 clamp-connected to the latter. On the rotary drill drive 35 a feeding means 36 can also be arranged, by means of which the drill rod 5, for the purpose of increasing the imposed load, can be moved axially relative to the clamping means 31 and therefore to the foundation element 3. The feeding means 36 can be of hydraulic design and have at least one linear drive that is connected on the one hand to the drill rod 5 and on the other hand to the clamping means 31.

To flush the drilling a flush drilling means with a flush line 61 is provided on the drill rod 5. The flush line 61 is coupled via a flush head 62 to the drill rod 5. For the removal of the drill spoil a gooseneck 59 is arranged on the drill rod 5, which has a pipe piece bent at approximately 90° and a subsequent pipe piece that runs approximately horizontally. Via this gooseneck 59 the drill spoil is discharged at a distance from the mouth of the drill-hole.

To receive the flush line 61 a winding device 60 is arranged on the working platform 2. The said device has a reel 67 for winding up the flush line 61. Furthermore, the winding device 60 has a deflection roller 68 that deflects the flush line, which runs in an approximately horizontal fashion from the reel 67, in the upward direction.

Laterally on the working platform 2 a total of four hydraulic supports 21 are arranged that jut out below the working platform 2 and are supported in a vertically displaceable manner on the working platform 2. To actuate the hydraulic supports 21 at least one hydraulic cylinder 22 is provided in each case, which is arranged in the illustrated example with its piston housing on the working platform 2 and is connected at its piston rod to the hydraulic support 21.

Figure 3:
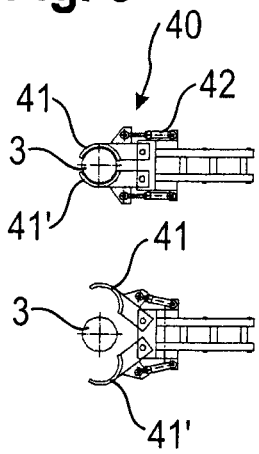
FIG. 3 shows an enlarged detailed view from above of the linear guide 40 of FIG. 1 in the closed condition (FIG. 3 above) and in the open condition (FIG. 3 below)

The linear guide 40 for the foundation element 3 is shown in detail in FIG. 3. As depicted in FIG. 3, the linear guide 40 is designed in a releasable manner, with the closed condition being shown in FIG. 3 above and the open condition being shown in FIG. 3 below. As shown in FIG. 3, the linear guide 40 has two jaw elements 41 and 41' respectively which correspond with the foundation element 3 and form in the closed condition a guide sleeve for the foundation element 3. To open and close the jaw elements 41, 41' a tong arrangement is provided that is actuated by hydraulic cylinders 42.

As is furthermore shown in FIG. 1, the linear guide 40 is arranged in a horizontally displaceable manner, i.e. in a direction disposed transversely to the feeding direction as well as transversely to the longitudinal axis of the foundation element 3, on the working platform 2. For active displacement of the linear guide 40 this has a linear drive 44 which is preferably designed as hydraulic cylinder and is coupled on the one hand to the linear guide 40 and on the other hand to the working platform 2.

In the case of the drilling unit 1 shown on the left in FIG. 1 the linear drive is extended and the linear guide 40 can guide the foundation element 3. In the case of the second drilling unit 1' shown on the right in FIG. 1 the linear drive 44' is retracted and the relevant linear guide 40' is withdrawn from the drilling axis of the corresponding drilling unit 1'. The withdrawal of the linear guide 40' makes it possible for the mounting part 30', which has a greater cross-section compared to the foundation element 3', to be lowered past the linear guide 40' towards the bottom of the working platform 2.

For operation of the rotary drill drive 35 and preferably also the remaining hydraulic units of the working platform 2 a common umbilical 70 is provided in the illustrated embodiment.

The use of the drilling unit of FIGS. 1 to 4 in an underwater foundation method according to the invention is shown in FIGS. 5 to 8.

Figure 5:
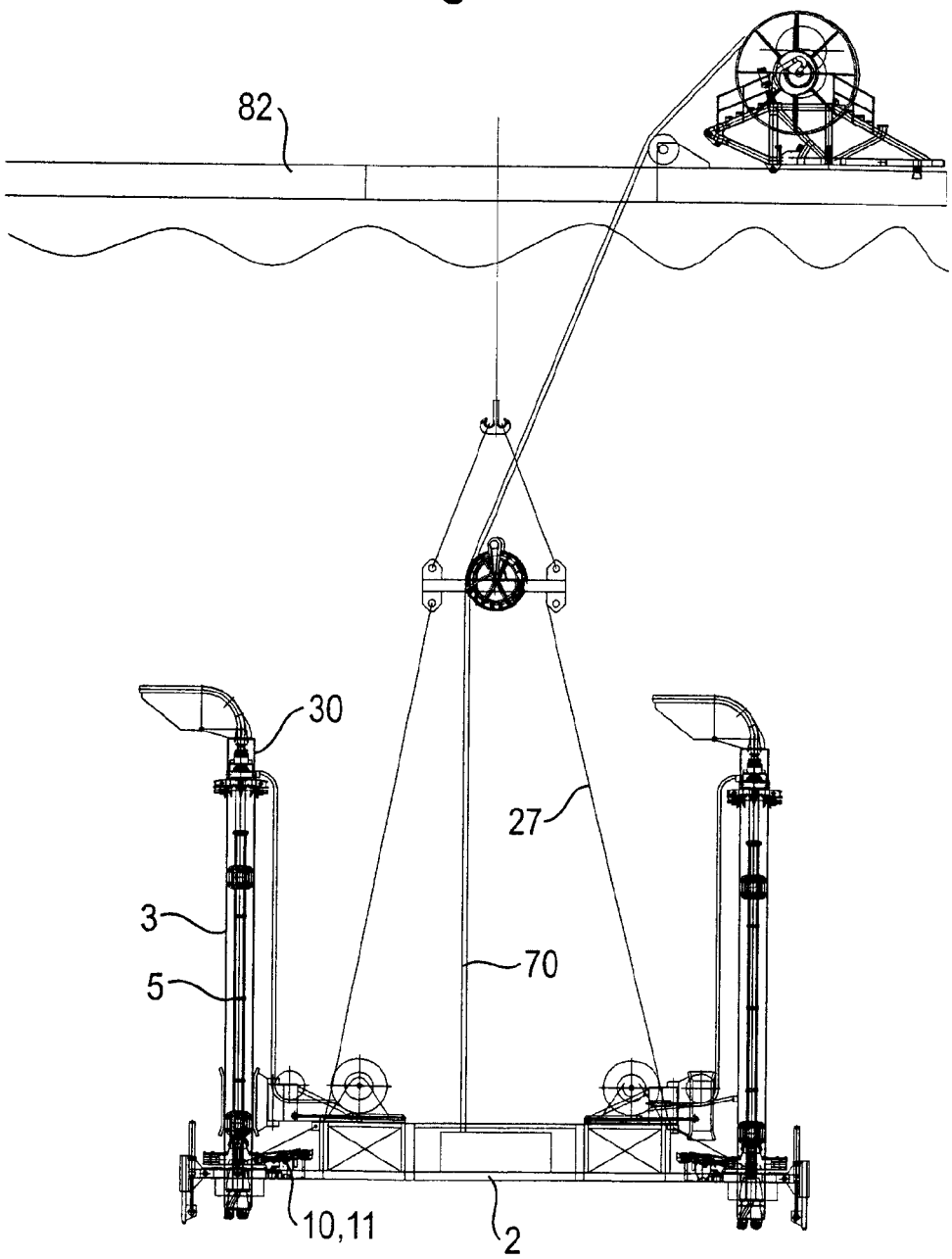
FIGS. 5 to 8 show different method stages during the use of the device of FIG. 1 for introducing a tubular foundation element into the bed of a body of water in a method according to the invention.

As depicted in FIG. 5, initially the foundation elements 3 and the drill rods 5 are arranged on the working platform 2 which preferably takes place above the water surface. For this purpose the foundation elements 3 are secured via the holding means 10, 11 on the working platform 2 and the mounting parts 30 with the drill rods 5 connected thereto are placed onto the foundation elements 3.

The working platform 2 loaded with the foundation elements 3 is then lowered by means of the cable arrangement 27 from a floating platform 82 or a ship.

Figure 6:
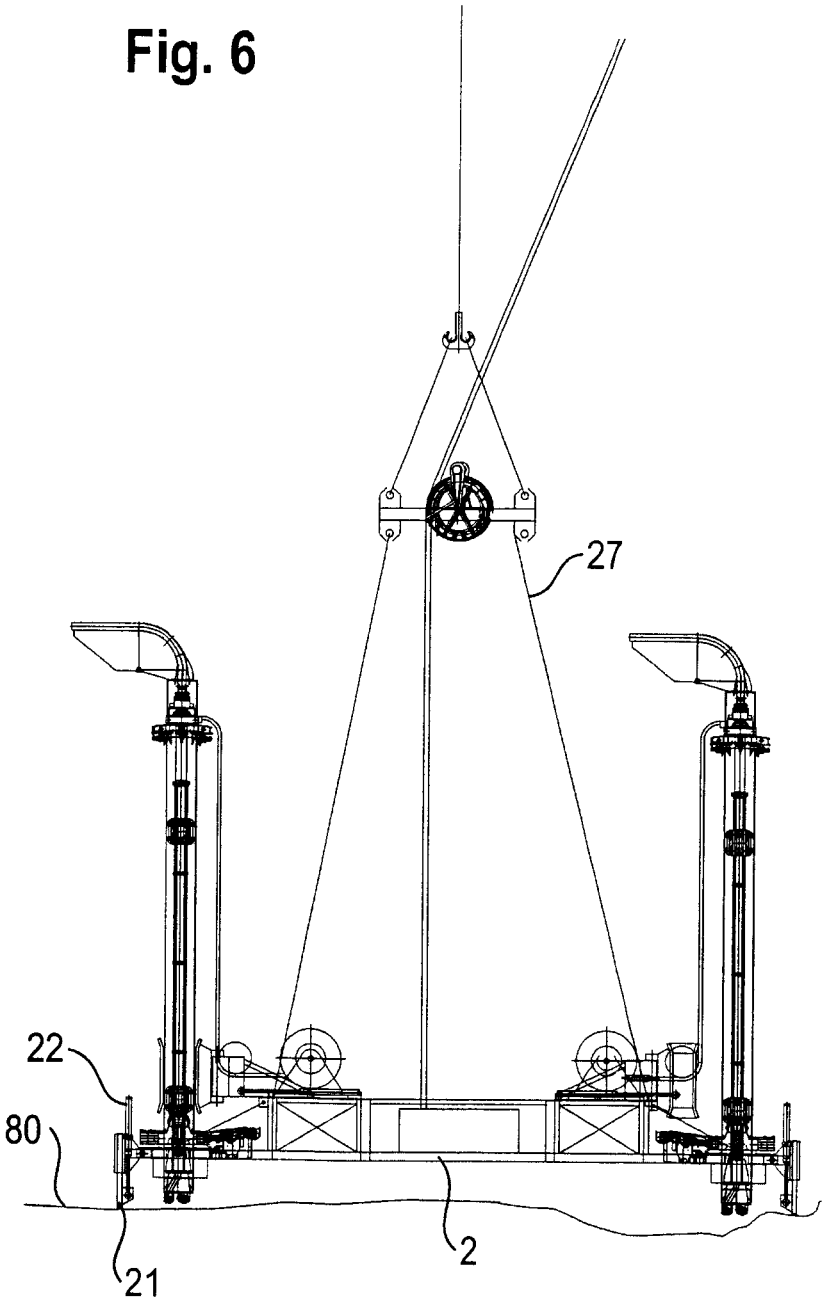

As shown in FIG. 6, the working platform 2, which constitutes a drilling template at the same time, is then placed onto the bed of a body of water 80 using the cable arrangement 27. Afterwards, the working platform 2 is aligned through actuation of the hydraulic supports 21, which rest on the bed of a body of water 80.

Figure 7:
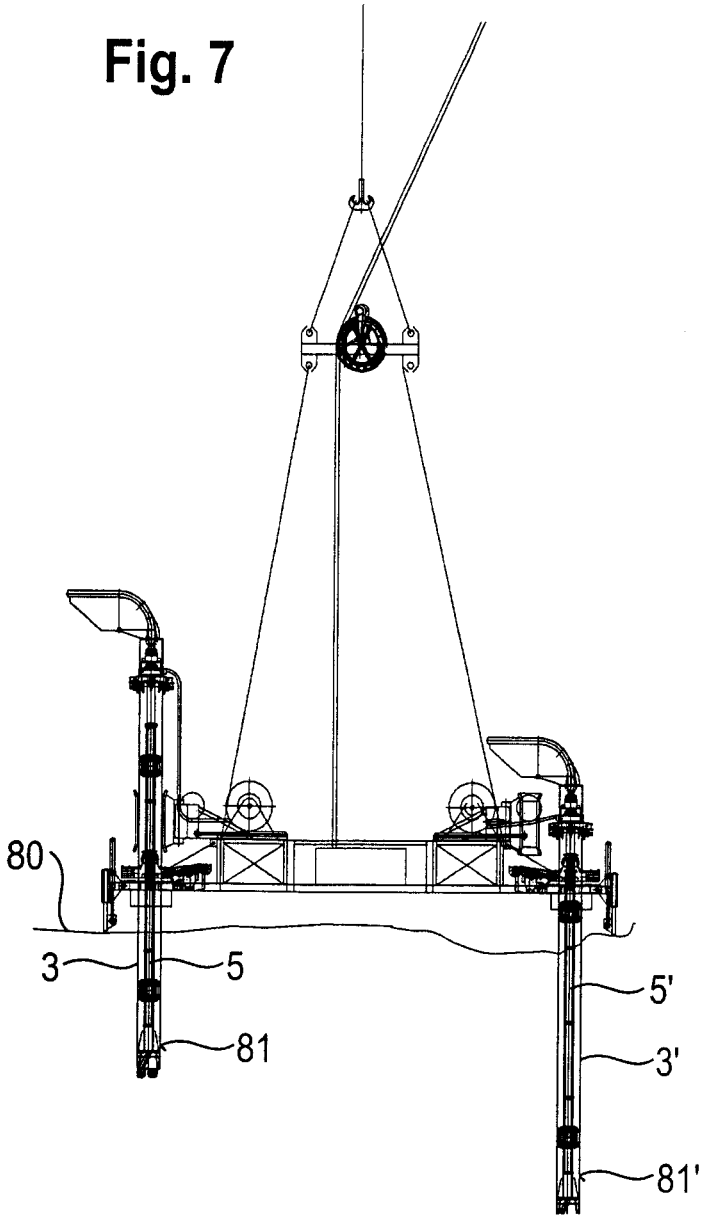

As illustrated in FIG. 7, the drilling process commences subsequently. Through rotational actuation of the drill rods 5 by means of the respective rotary drill drives 35 drill-holes 81 are produced in the bed of a body of water 80. To increase the imposed load in the process the feeding means 36 can be actuated. The foundation elements 3 are sunk as a result of their proper weight into the excavated drill-holes 81. To this end the means 11 for axially securing the foundation element 3 can be released repeatedly.

Figure 8:
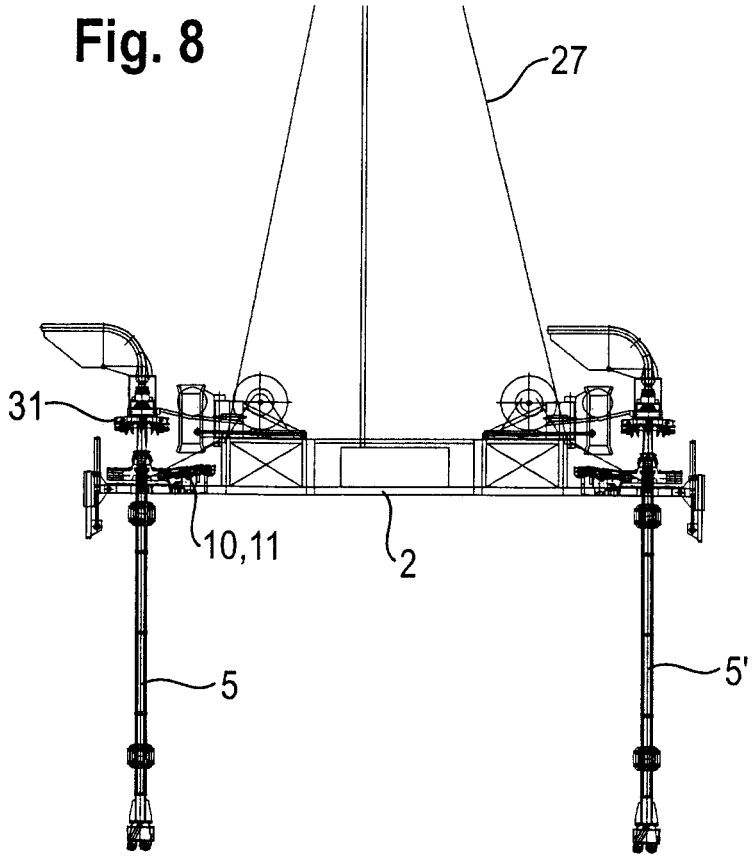
Figure 8:
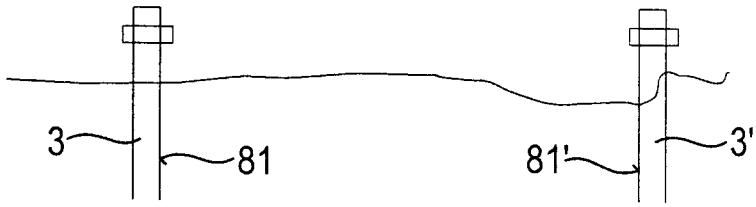

As shown in FIG. 8, following the drilling process the working platform 2 is recovered together with the drill rods 5 by hauling in the cable arrangement 27. In doing so, the foundation elements 3 remain in the ground. For recovery of the drill rods 5 the clamping means 31, which have connected the drill rods 5 to the respective foundation elements 3 so far, are released and the foundation elements 3 are released from the means 11 for axial securing of the foundation elements 3. The means 11 can then serve for securing the drill rods 5 on the working platform 2.

The foundation elements 3 introduced into the bed of a body of water 80 can be filled e.g. with a settable suspension, in particular with concrete, and/or serve for the support of underwater structures.

The invention claimed is:

1. Underwater drilling arrangement for introducing a tubular foundation element into the bed of a body of water comprising:

at least one rotary drill drive, whereby a drill rod running inside the foundation element is capable to be set into rotation by the rotary drill drive, wherein a submersible working platform for placement onto the bed of the body of water is provided, whereby on the working platform at least one holding mechanism to secure the foundation element in a rotationally fixed manner on the working platform is arranged, and at least one mounting part for placement onto the foundation element is provided, whereby the mounting part has a clamping mechanism to secure the mounting part on the foundation element, the rotary drill drive is arranged on the mounting part, the drill rod is secured on the working platform and the clamping mechanism is configured to be uncoupled to release the drill rod from the foundation element for recovering the working platform together with the drill rod on completion of a drill-hole.

2. Underwater drilling arrangement according to claim 1, wherein on the mounting part at least one feeding mechanism for axial displacement of the drill rod is arranged.

3. Underwater drilling arrangement according to claim 1, wherein securing mechanisms configured to axially secure the foundation element in a releasable manner on the working platform are provided, whereby the securing mechanisms are provided on the holding mechanism for securing the foundation element in a rotationally fixed manner.

4. Underwater drilling arrangement according to claim 1, wherein the clamping mechanism for securing the mounting part on the foundation element has at least one hydraulic clamp.

5. Underwater drilling arrangement according to claim 1, wherein on the working platform at least one linear guide for the foundation element is arranged.

6. Underwater drilling arrangement according to claim 5, wherein the linear guide can be released from the foundation element, the linear guide has at least two jaw elements, and the linear guide can be moved transversely to its guiding direction on the working platform.

7. Underwater drilling arrangement according to claim 1, wherein the working platform has hydraulic supports for aligning the working platform on the bed of the body of water.

8. Underwater drilling arrangement according to claim 1, wherein for adjustment of a drilling point at least the holding mechanism for the foundation element can be moved relative to the working platform.

9. Underwater drilling arrangement according to claim 1, wherein on the working platform several drilling units are provided, whereby a drilling unit each has at least one holding mechanism for securing a foundation element in a rotationally fixed manner on the working platform.

10. Underwater drilling arrangement according to claim 1, wherein the drill rod has a flush drilling mechanism, the drill rod has a gooseneck for drill spoil removal, the drill rod has at least one drill collar in order to increase the imposed load and in that the drill rod has a full-cut drill head with roller bits.

11. Underwater drilling arrangement according to claim 1, wherein on the working platform a winding device for at least one flush line is provided.

12. Method for introducing a tubular foundation element into the bed of a body of water, in which a submersible working platform is provided, the foundation element is secured by means of a holding means on the working platform, a mounting part is placed onto the foundation element and secured on the foundation element by means of a clamping means, the working platform is submerged and placed onto the bed of the body of water, by means of a rotary drill drive arranged on the mounting part a drill rod running inside the foundation element is set into rotation and introduced into the bed of a body of water whilst producing a drill-hole, whereby the foundation element is sunk into the drill-hole as a result of its proper weight, and on completion of the drill-hole the working platform is recovered together with the drill rod.

13. Method according to claim 12, wherein prior to the placement of the working platform onto the bed of the body of water the foundation element is arranged on the working platform and secured axially on the said working platform.

14. Method according to claim 12, wherein the mounting part is placed onto the foundation element prior to the placement of the working platform onto the bed of the body of water.

* * * * *